US008348540B2

(12) United States Patent
Bedhome et al.

(10) Patent No.: US 8,348,540 B2
(45) Date of Patent: Jan. 8, 2013

(54) WRITING INSTRUMENT CONTAINING A GRANULAR MATERIAL IN THE INK CHAMBER

(75) Inventors: Vincent Bedhome, Dezvres (FR); Didier Lange, Saint Leonard (FR); Franck Rolion, Asnieres sur Oise (FR)

(73) Assignee: Societe BIC, Clichy Cedex (FR)

( * ) Notice: Subject to any disclaimer, the term of this patent is extended or adjusted under 35 U.S.C. 154(b) by 641 days.

(21) Appl. No.: 12/160,846

(22) PCT Filed: Jan. 12, 2007

(86) PCT No.: PCT/FR2007/000062

§ 371 (c)(1), (2), (4) Date: Sep. 2, 2008

(87) PCT Pub. No.: WO2007/080331

PCT Pub. Date: Jul. 19, 2007

(65) Prior Publication Data

US 2010/0158600 A1 Jun. 24, 2010

(30) Foreign Application Priority Data

Jan. 13, 2006 (FR) ..... 06 00335

(51) Int. Cl.
*B43K 5/00* (2006.01)

(52) U.S. Cl. ..... 401/199; 401/198; 401/223

(58) Field of Classification Search ..... 401/199, 401/200, 223, 196, 198, 192
See application file for complete search history.

(56) References Cited

U.S. PATENT DOCUMENTS

| | | | | |
|---|---|---|---|---|
| 2,097,256 | A | 10/1937 | Salz | |
| 2,462,929 | A | 3/1949 | Zodtner | |
| 2,528,408 | A | 10/1950 | Zodtner | |
| 2,911,949 | A * | 11/1959 | Beckwith | 401/212 |
| 7,070,352 | B2 * | 7/2006 | Iida et al. | 401/192 |
| 8,096,725 | B2 * | 1/2012 | Bedhome et al. | 401/199 |

FOREIGN PATENT DOCUMENTS

| | | |
|---|---|---|
| CH | 516 413 | 12/1971 |
| DE | 24 37 503 | 2/1976 |
| DE | 38 24 941 | 2/1990 |
| EP | 1 510 560 A1 | 3/2005 |
| FR | 1 026 695 | 4/1953 |
| GB | 688 892 | 3/1953 |

* cited by examiner

*Primary Examiner* — David Walczak
*Assistant Examiner* — Jennifer C Chiang
(74) *Attorney, Agent, or Firm* — Jones Day

(57) ABSTRACT

A writing instrument that includes an ink reservoir and a writing tip fluidly connected to the reservoir and through which the ink comes out during use of the instrument. The reservoir contains, in addition to the ink, grains that are separate and that may have angles and sharp edges of dimensions that are significant relative to an apparent dimension (d) of the grains.

15 Claims, 1 Drawing Sheet

WRITING INSTRUMENT CONTAINING A GRANULAR MATERIAL IN THE INK CHAMBER

CROSS-REFERENCE TO RELATED APPLICATIONS

This application is a national stage application of International Application No. PCT/FR2007/000062, filed on Jan. 12, 2007, which claims priority to French Patent Application No. 06 00335 filed on Jan. 13, 2006, the entire contents of both applications being incorporated herein by reference.

BACKGROUND OF INVENTION

1. Field of Invention

The embodiments of the present invention relate to a writing instrument that incorporates a granular material in its ink reservoir.

2. Description of the Related Art

An ink reservoir design of this type is known from U.S. Pat. No. 2,528,408. Specifically, this document discloses a nib pen whose ink reservoir is provided with a granular material. The structure of this material gives it a capillarity versus the ink that is suitable for obtaining a steady supply of ink to the nib. However, to obtain this capillarity, the granular material is sintered or has a distribution of grains inside the reservoir that is controlled. A sintered material that has a determined open porosity is difficult to produce in large runs in a reproducible manner. The sintering step then generates a considerable additional cost for the pen. In addition, filling the reservoir with the ink is made difficult, because the ink is slow to penetrate the interstices of the sintered granular material. Furthermore, when the granular material has to be distributed in a controlled manner in the form of separate grains in the reservoir, the grains must be placed in the reservoir in several steps, which represents an awkward and lengthy step in the manufacture of the pen. These disadvantages explain why no solution of this type is applied industrially in the present day. Specifically, the solutions chosen, particularly for porous writing tips, consist in placing a filler of synthetic fibrous material in the ink reservoir, or more recently, in storing the ink freely in the reservoir, that is to say with no filler material, and in fluidly connecting this reservoir to the tip by means of a controlled capillarity connector.

Furthermore, European patent application EP 1 510 560 discloses an ink composition that includes solid particles, particularly silica particles having a dimension less than 200 μm (microns). In this case, the silica particles form an integral part of the ink, that is to say that they are designed to be deposited with the colorants and the solvent of the ink on a writing medium such as paper. To prevent a writing instrument from being obstructed by the silica particles, the latter must represent less than 5% in weight of the ink. In these conditions, the capillarity of the reservoir of the writing instrument relative to the ink is not significantly improved.

SUMMARY OF THE INVENTION

One aim of the embodiments of the present invention is to improve the capillarity of the ink in the reservoir of the writing instrument in order to obtain an even supply of ink to the nib, while allowing the reservoir to be filled rapidly during the manufacture of the instrument.

For this, the embodiments of the present invention propose a writing instrument that comprises an ink reservoir and a writing tip fluidly connected to this reservoir and through which the ink comes out during use of the instrument. The reservoir contains, in addition to the ink, separate grains that have angles and sharp edges of dimensions that are significant relative to an apparent dimension d of said grains.

The presence of angles and sharp edges on the grains must contribute to a capillary behavior of the ink in the reservoir which provides the writing tip with an even supply of the ink, more than the arrangement of the grains amongst themselves. These angles and sharp edges result from the external shape of the grains. These are therefore reliefs having dimensions of the same order of magnitude as the apparent dimension d, or the granulometry, of a grain in question, that is to say from a few tenths to a few hundredths of its apparent dimension d. The ink flow through the tip is then constant. In addition, a considerable proportion of the ink initially contained in the reservoir may be restored during a prolonged use of the writing instrument. It is supposed that these large angles and sharp edges favorably modify the dynamics of the fluids of the ink between the grains, and even the physical-chemical interactions between the ink and the grains, which would improve the return of the ink contained in the capillary spaces formed between the grains. Additionally, the capillary spaces between the grains have shapes and volumes that are substantially variable because of the irregular shape of the grains, which would have a favorable effect on regulating the flow of ink that the reservoir delivers in its totality.

The presence of angles and sharp edges also limits a consolidation or compaction of the grains in the reservoir, when the writing instrument is kept immobile in a fixed position. The operation of the writing instrument is then relatively unaffected by prolonged storage of the instrument without agitation of the grains.

The presence of the separate grains in the reservoir, which are submerged in the ink, also makes it possible to attenuate increased pressures in the ink that are likely to be caused by impacts on the writing instrument. Leaks of ink through the writing tip that such impacts could cause are then reduced or prevented.

Since the grains are separate, that is to say that they are not linked together, they may be simply poured into the reservoir even if the shape of the latter is complex, and the ink can then be injected into the reservoir by means of a hollow needle. For example, the needle may be sunk into the grains to the bottom of the reservoir, and then the ink is expressed from the needle between the grains during a gradual retraction of the needle. A rapid and uniform filling of the reservoir can then be easily obtained.

Finally, the use of separate grains allows a good ventilation of the ink reservoir. A device for venting the reservoir that is particularly simple may then be used. In particular, the use of a simplified venting device makes it possible to design and produce writing instruments that have complex or original shapes.

In various embodiments of the invention it is optionally also possible to use, in addition, one and/or another of the following arrangements that constitute enhancements of the invention:

- the grains are essentially nonporous;
- at least certain of the grains can be constituted of a mineral material;
- the mineral material of certain of the grains may comprise sand, calcium carbonate, corundum or ground glass;
- the grains may have an average dimension, determined by laser granulometry on all of the grains contained in the reservoir, lying between 40 μm and 550 μm;
- 95% of the grains contained in the reservoir may have at least one dimension less than 800 μm;

95% of the grains contained in the reservoir may have at least one dimension greater than 0.5 μm, and particularly greater than 150 μm;

the individual dimension of the grains may vary in a ratio of less than 10 for 95% of the grains contained in the reservoir;

the grains may have a granulometric distribution according to their individual dimension that has a single maximum;

the grains may be at least partly mobile in the reservoir;

a portion of the volume of the reservoir, which may be greater than 10% of the latter, may be free of grains;

the portion of the volume of the reservoir that is free of grains may be less than 30% of the latter, and preferably less than 20%; and the ink may be a liquid ink and preferably an ink of the aqueous type.

If necessary the reservoir may have a wall that is at least partly transparent. Such a wall allows a user of the writing instrument to see the quantity of ink that remains in the reservoir after a certain period of use of the instrument.

Finally, the embodiments of the present invention may be applied to writing instruments of different types. Particularly, the writing tip may be a porous capillary tip, for example for a marker or a felt-tip pen, a ball tip or an ink roller tip.

BRIEF DESCRIPTION OF THE DRAWINGS

Other particular features and advantages of the embodiments of the present invention will become apparent in the following description of a nonlimiting exemplary embodiment, with reference to the appended drawings, in which.

DETAILED DESCRIPTION OF THE EMBODIMENTS OF THE PRESENT INVENTION

Figure 1:
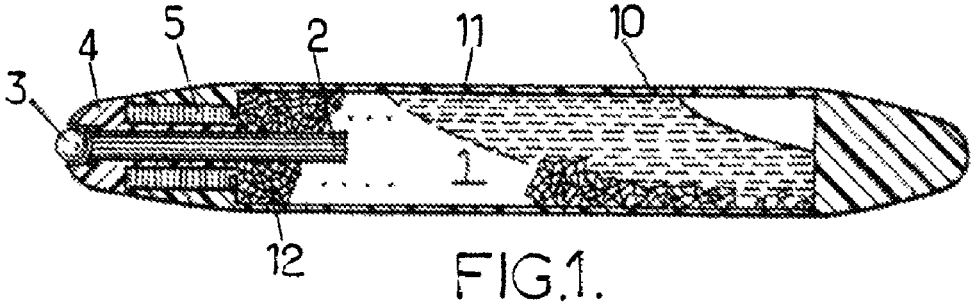
FIG. 1 is a section view of a writing instrument according to an embodiment of the present invention.

It is understood that the dimensions of the various portions of the writing instrument that are shown in FIG. 1 do not correspond either to real dimensions or to real dimension ratios. In particular, these dimensions may be adapted to obtain a writing instrument that has a greater ink content, or to produce a writing instrument that has a pocket format.

As an example, the writing instrument shown in FIG. 1 is of the "roller pen" type. It comprises an ink reservoir 1 that is limited by a side wall 10, a connector 2, and an ink roller 3 which forms the writing tip. The ink roller 3 is held, while remaining free to rotate, by the mount 4 that is attached to an anterior end of the reservoir 1. The connector 2 allows a flow of the ink 11 that is contained in the reservoir 1 toward the ink roller 3. It may consist of a cylindrical assembly of fibers aligned longitudinally and designed to be impregnated by the ink 11. If necessary, one end of the connector 2 may protrude into the reservoir 1 in order to obtain a good impregnation of the connector 2 over the whole of its length. Finally, a device 5 for venting the reservoir 1 may be inserted between the mount 4 and the reservoir 1, in order to compensate for the pressure variations in the reservoir 1, particularly when the ink 11 comes out through the writing tip of the instrument. The venting device 5 may consist of a set of baffles but other pressure-compensation devices may be used as an alternative.

Separate grains 12 of a solid material are contained in the reservoir 1, with the ink 11. These grains 12 may completely fill the volume of the reservoir 1. They are then immobilized one against the other. Alternatively, the grains 12 may occupy only a determined fraction of the volume of the reservoir 1, such as for example 90% of the latter. In this case, 10% of the volume of the reservoir 1 is free of grains. When the grains do not completely fill the reservoir 1, they may move in the latter during an agitation of the writing instrument, or only under the effect of the movements applied to the instrument during normal use.

The ink 11 that is contained in the reservoir 1 is distributed between the grains 12, in interstices formed by adjacent grains. When the writing instrument is used, the ink 11 flows between the grains 12 inside the reservoir 1 with an apparent capillarity that allows the ink roller 3 to be evenly supplied with ink. The inventors have discovered that this apparent capillarity is modified by the shape of the grains 12 and that the edges on the surface of these grains make it possible to obtain a particularly even flow of the ink 11 at the writing tip, and in any event it is significantly more even than in the presence of the connector 2 alone.

The inventors have also noted that possible movements of the grains 12 relative to one another also contribute to obtaining an even flow of the ink 11. Specifically, the ink 11 may form bubbles or clusters in clogging microzones inside the reservoir 1. Movements of the grains then make it possible to eliminate such bubbles and to dissolve clusters. The movement of the grains may also be beneficially used to prevent a sedimentation of the ink.

When an impact is applied to the writing instrument, the grains 12, because they can move relative to one another, cushion a possible increased pressure in the ink 11. This cushioning results from the friction that occurs along the ridges of the grains. In this manner, no leakage of ink occurs through the writing tip nor through the device 5 for venting the ink reservoir.

Advantageously, the wall 10 of the reservoir 1 may be transparent, or may have a transparent window, in order to view the level of ink 11 remaining in the reservoir.

The ink 11 preferably has a low viscosity. In other words, the ink 11 is liquid, as opposed to the oily inks whose viscosity is high. This may be an aqueous solvent ink, in particular. In this case, the inventors have noted that the ink could be delivered with a particularly even flow to the writing tip, throughout the lifetime of the writing instrument. In particular, no gradual reduction of the supply of ink to the writing tip occurs before this supply finally stops.

In addition, a reservoir with grains according to an embodiment of the invention provides a rate of return, in writing form, of a quantity of aqueous ink initially placed in the reservoir that is greater than the rate obtained with a fiber filler reservoir. In particular, a gain in return of at least 10% has been observed for certain prototypes according to an embodiment of the invention.

However, the use of an ink with an alcoholic or other solvent is perfectly envisageable.

It is furthermore known that the use of a pigmented ink may cause a variation in density of coloration of the writing line, between a use of the writing instrument carried out after the instrument has been stored in a tip upward position, and a use after storage with the tip downward. The use of grains that can move inside the reservoir makes it possible to reduce, if not eliminate, such a variation. Specifically, the density of coloration of the ink line may be recovered by shaking the writing instrument.

When the grains 12 are mineral grains, a capillary behavior of the ink 11 is observed in the reservoir 1, which is all the more favorable for obtaining an even flow of the ink through the writing tip. The material of the grains may be of oxide or carbonate type. Alumina, particularly of the corundum type, silica, ground glass, or calcium carbonate are grain materials for which satisfactory operations of the writing instrument have been observed. In addition, these materials are chemically inert with respect to the inks used.

Remarkable operating performances of the writing instrument have also been obtained with grains of sand placed in the reservoir 1. "Sand" means an essentially silica-based or calcium carbonate-based powder of natural origin. Several origins of sand have been tested, which correspond to various quarries. Improved operating performances of the writing instrument have been obtained with natural sands of various origins. It nevertheless appears after many tests that, for a given ink, certain origins of sand give better results.

Figure 2:
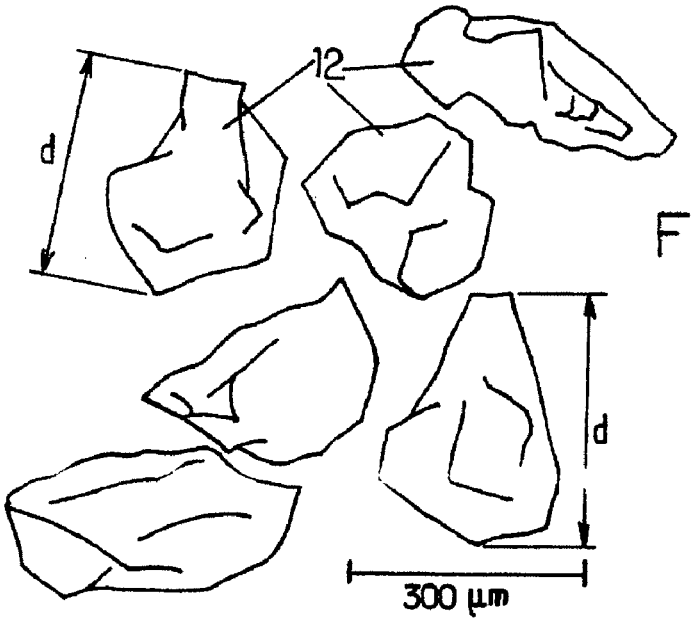
FIG. 2 illustrates schematically sand grains used for an embodiment of the invention.

FIG. 2 reproduces schematically a micrograph of such grains of sand 12. This micrograph has been produced by a scanning electron microscope, with a ×100 magnification. The sharp edges are very visible, as are the angles between these edges. They are therefore angles and sharp edges of large dimensions relative to the apparent dimension d of the grain. These macroscopic angles and sharp edges are understood to substantially and beneficially modify the interactions between the grains 12 and the ink 11.

The interstices between the grains 12 therefore form capillary spaces of extremely variable volume and shape because of the irregular shape of each of the grains. It seems that this improves the evenness of the ink flow that the whole of the reservoir 1 delivers, even though, locally, the flow delivered by different interstices varies considerably. Specifically, the dimensions of the reservoir 1 mean that each section of the latter comprises a large number of grains 12.

It will be understood that it is the interstices between the grains 12, and the possible portion free of grains, that form the effective volume of the ink reservoir 1, since the grains of sand 12 have a virtually zero porosity to the ink. It seems highly preferably that the grains be essentially nonporous to the ink, in order to obtain the considerable ink return rate observed.

It is not however out of the question to use grains having a sufficient porosity to contain in their pores a not inconsiderable quantity of ink but at the risk of seeing this ink retained in the pores because of the small dimensions of the latter relative to the grains and the interstices. It will be noted that, even in this case, the grains must have externally angles and sharp edges of large dimensions so that the capillary spaces between the grains play their role, it being understood that the openings of the pores cannot in themselves form such angles and sharp edges. Similarly, microscopic defects or reliefs on the surface of rounded grains or of beads would not make it possible to obtain the same effects of capillarity of the grains and the interstices with respect to the ink.

Figure 3:
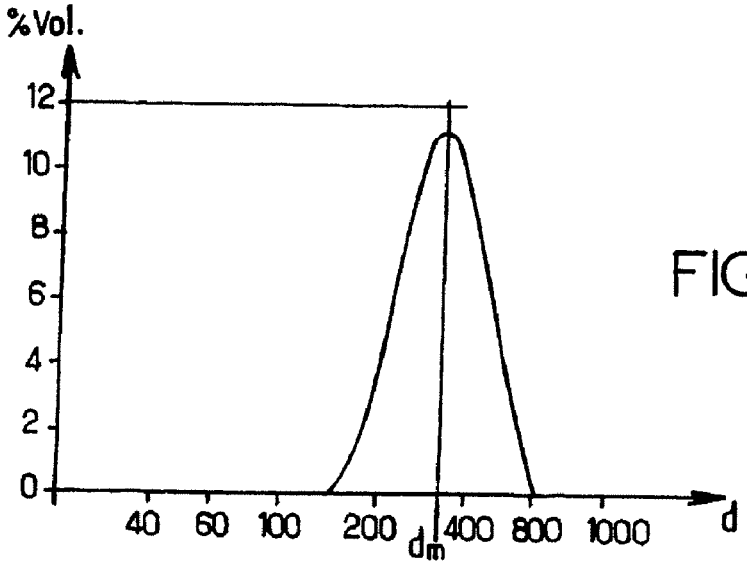
FIG. 3 is a diagram of the granulometric distribution of the grains contained in a writing instrument according to an embodiment of the invention.

FIG. 3 is a typical distribution diagram for the dimension of the grains of sand. This granulometric analysis was produced by means of a laser, using a commercially available apparatus. The horizontal axis indicates, in microns, the apparent dimension d of each grain, and the vertical axis identifies the fraction of the total volume of sand analyzed whose grains have the dimension indicated by the horizontal axis. The surface area lying between the curve and the horizontal axis therefore corresponds to 100%. 95% of the grains of the sand sample corresponding to FIG. 3 have at least one dimension greater than 150 μm. Simultaneously, 95% of the grains have at least one dimension less than 750 μm. The curve shows a maximum for the grain dimension of 320 μm approximately. This dimension, marked $d_m$, is also roughly equal to the average dimension of the grains, calculated over the whole sand sample analyzed. Such dimensions are adapted so that a large number of grains is simultaneously contained in the reservoir 1, which statistically ensures a homogeneous and reproducible behavior of the mixture of the grains 12 and of the ink 11 inside the reservoir 1. In addition, these grain dimensions are large enough to prevent certain grains 12 from being drawn by the ink 11 into the connector 2, or possibly brought into contact with the ink roller 3. A possible obstruction of the connector 2 and/or a rotational blockage of the ink roller 3 are therefore prevented.

Grains of sand that have dimensions different than those indicated by FIG. 3 have also given satisfactory characteristics of operation of the writing instrument. Nevertheless, the inventors have noted that the best characteristics are obtained when the average dimension of the grains $d_m$ lies between 40 μm and 550 μm, and/or when 95% of the grains have a dimension d less than 800 μm, and/or when 95% of the grains have a dimension d greater than 0.5 μm, preferably greater than 150 μm. Furthermore, it is preferable that the grains 12 that are contained in the reservoir 1 have limited dimensional variations. In particular, the individual dimension of the grains d preferably varies in a ratio of less than 10, for 95% of the grains. Such a granulometric characteristic makes it possible to prevent a large number of interstices between the largest grains being filled by smaller grains. The ink capacity of the reservoir 1 is then greater. This also makes it possible to prevent a compaction or segregation of the grains 12 according to their size, which would occur in the reservoir 1 after a long period of immobility of the writing instrument. The operation of the writing instrument is then constant, even at the time of a resumption of use. Finally, this also reduces the risk of the formation of a vault by the grains in the reservoir, which could disrupt the evenness with which the writing tip is supplied with ink. Similarly, a granulometric distribution of the grains according to their respective dimensions which has only one maximum constitutes another criterion for ensuring that the interstices between the grains form a free volume sufficient for the ink.

It will be noted that the natural sand forming the grains 12 may undergo washings, for example to prevent particles of powder or dust on the surface of the grains adversely affecting their capillarity properties. However, treatments modifying the surface of the grains, such as for example chemical attacks or deposits, should preferably be excluded, given the satisfactory results obtained by the shape of the grains and the cost that such treatments could incur.

In the preferred embodiment described above, the reservoir 1 contains only grains of the same kind and preferably of mineral material. Nevertheless it is not out of the question for the reservoir to contain a fraction of grains of a different kind, for example made of polymer or metal, or else for it to contain a fibrous element particularly in order to limit the mobility of the grains.

It is understood that the writing instrument that has been described in detail hereinabove may be modified while retaining at least some of the advantages of the embodiments of the present invention. In particular, the embodiments of the present invention are not limited in their application to a writing instrument of the "roller pen" type, and can be applied to all types of writing instruments, such as pens, particularly fountain pens, markers, or coloring or underlining instruments.

The invention claimed is:

1. A writing instrument comprising an ink reservoir and a writing tip fluidly connected to the reservoir and through which the ink comes out during use of the writing instrument, the reservoir comprising, in addition to the ink, grains that are separate and that have angles and sharp edges having dimensions of the same order as a granulometry dimension (d) of the grains, the grains comprising sand grains and being essentially nonporous.

2. The writing instrument according to claim 1, wherein the grains have irregular forms.

3. The writing instrument according to claim 1, wherein the grains have an average granulometry dimension, determined by laser granulometry on all the grains contained in the reservoir, between 40 μm and 550 μm.

4. The writing instrument according to claim 1, wherein 95% of the grains contained in the reservoir have at least one granulometry dimension less than 800 μm.

5. The writing instrument according to claim 1, wherein 95% of the grains contained in the reservoir have at least one granulometry dimension greater than 0.5 μm.

6. The writing instrument according to claim 4, wherein 95% of the grains contained in the reservoir have at least one granulometry dimension greater than 150 μm.

7. The writing instrument according to claim 1, wherein the individual granulometry dimension of the grains varies in a ratio of less than 10 for 95% of the grains contained in the reservoir.

8. The writing instrument according to claim 1, wherein the grains have a granulometric distribution, according to their individual granulometry dimension, that has a single maximum.

9. The writing instrument according to claim 1, wherein the grains are at least partly mobile in the reservoir.

10. The writing instrument according to claim 8, wherein a portion of the volume of the reservoir is free of grains.

11. The writing instrument according to claim 10, wherein the portion of the reservoir that is free of grains is less than 30% of the volume of the reservoir.

12. The writing instrument according to claim 1, wherein the reservoir has a wall that is at least partly transparent.

13. The writing instrument according to claim 1, wherein the writing tip is a porous capillary tip, a ball tip or an ink roller tip.

14. The writing instrument according to claim 1, wherein the ink is liquid and aqueous.

15. A writing instrument comprising an ink reservoir and a writing tip fluidly connected to the reservoir and through which the ink comes out during use of the instrument, the reservoir containing, in addition to the ink, grains that are separate and that have angles and sharp edges having dimensions of the same order as a granulometry dimension (d) of the grains, the grains being essentially nonporous and comprising grains made of a mineral material that comprises calcium carbonate or alumina.

* * * * *